United States Patent [19]

Harrigan

[11] 4,077,400

[45] Mar. 7, 1978

[54] EXTERNAL CARDIAC RESUSCITATION AID

[76] Inventor: Roy Major Harrigan, Bromley Mtn. Rd., Manchester, Vt. 05254

[21] Appl. No.: 609,109

[22] Filed: Aug. 29, 1975

Related U.S. Application Data

[63] Continuation-in-part of Ser. No. 541,762, Jan. 17, 1975, abandoned.

[51] Int. Cl.[2] ..... A61H 1/00

[52] U.S. Cl. ..... 128/24 R; 128/28

[58] Field of Search ..... 128/24 R, 28, 50, 51, 128/52, 67, 2 N, 2 S; 35/17

[56] References Cited

U.S. PATENT DOCUMENTS

| | | | |
|---|---|---|---|
| 587,891 | 8/1897 | Walker | 128/24 R |
| 2,839,050 | 6/1958 | Sokol | 128/2 S |
| 3,199,225 | 8/1965 | Robertson et al. | 35/17 |
| 3,219,031 | 11/1965 | Rentsch, Jr. | 128/51 |
| 3,254,645 | 6/1966 | Rand et al. | 128/52 |
| 3,276,147 | 10/1966 | Padellford | 35/17 |
| 3,307,541 | 3/1967 | Hewson | 128/145.8 |
| 3,489,140 | 1/1970 | Mullikin | 128/51 |
| 3,489,140 | 1/1970 | Mullikin | 128/51 |
| 3,562,925 | 2/1971 | Baermann et al. | 35/17 |
| 3,898,983 | 8/1975 | Elam | 128/2 N |

FOREIGN PATENT DOCUMENTS

| | | | |
|---|---|---|---|
| 260,450 | 6/1963 | Australia | 35/17 |
| 791,741 | 3/1958 | United Kingdom | 35/17 |

*Primary Examiner*—John D. Yasko
*Attorney, Agent, or Firm*—Donald Kettlestrings

[57] ABSTRACT

Effectiveness and safety of external cardiac resuscitation is increased by the use of a small inflatable "pillow" which has a pressure gauge calibrated to read out the downward force or pressure applied to the victim's chest. The device is placed on the victim's chest and force is applied onto the device allowing the user to observe and control the force or pressure being applied to the victim.

65 Claims, 5 Drawing Figures

EXTERNAL CARDIAC RESUSCITATION AID

CROSS-REFERENCE TO RELATED APPLICATION

The present application is a continuation-in-part of my copending application for EXTERNAL CARDIAC RESUSCITATION AID, filed Jan. 17, 1975, serial number 541,762 now abandoned.

This invention relates to a small inflatable "pillow" provided with a pressure gauge for enabling a rescuer to accurately control the force or pressure applied to the victim's chest when administering external cardiac resuscitation.

When the heart is stopped as a result of injury, poisoning, electric shock, heart attack or other causes, circulation sufficient to maintain life may be maintained by the rythmic application of the correct amount of pressure to the chest. This technique is known as manual, external, cardiac compression, and when combined with artifical respiration it is called cardiopulmonary resuscitation (CPR).

In adult males, for example, the correct pressure or force that should be applied to the chest is approximately 90 pounds. If too little pressure is applied the circulation created, if any, will not be sufficient to prevent brain damage or even death. On the other hand, if the pressure applied is too great, broken ribs, punctured lungs and other damage may result. Further, application of pressure on too small an area of the chest can more readily result in broken ribs and other damage, for example, if the knuckles of the rescuer's hand are pressing on the victim's ribs. Also, if the pressure is not applied evenly but applied in quick jabs, the likelihood of injury is increased, and if the pressure is not applied rythmically and with proper timing, satisfactory results may not be obtained.

Therefore, it is an object of this invention to provide a method and apparatus whereby the pressure applied during external cardiac resuscitation may be observed by the person administering such aid.

It is a further object of this invention to provide an inexpensive and compact device which will indicate the amount of pressure or force applied during external cardiac resuscitation.

It is also an object of this invention to provide an inexpensive and compact pressure distribution device which optionally may not have the pressure measuring and indicating means.

It is another object of this invention to provide one or more of the above described devices with a timing indication means to insure that the rescuer will use the appropriate rythmn in the application of external cardiac resuscitation.

It is a further object of the invention to provide the above-mentioned devices with an adhesive backing so that the device is secured and located in the proper position on the victim.

Additional objects and advantages of the invention will be set forth in part in the description which follows, and in part will be obvious from the description or may be learned by practice of the invention. The objects and advantages are realized and attained by means of the instrumentalities and combinations particularly pointed out in the appended claims.

To achieve these and other objects the present invention provides for an inflatable structure of heavy vinyl or other suitable material approximately three inches square and two inches high (when inflated) having a pressure indicating device such as a pressure gauge associated therewith. The structure is inflated by mouth through a suitable inflation valve such as are found on air mattresses. The gauge may be calibrated to indicate the pressure or force applied to a victim by placing the inflatable structure on a spring weight scale and applying various pressures, (especially in the range required for external cardiac resuscitation) on the structure and recording these pressures from the spring weight scale onto the face of the pressure gauge indicator face. In experiments it has been found that a pressure of eight pounds per square inch on the gauge is representative of a downward force on the inflatable structure of ninety pounds.

In use, the above described external cardiac resuscitation aid is inflated by mouth and placed on a victim's chest over the lower sternum, and pressure or force is applied to the victim's chest directly through the device. The user will observe the gauge to obtain a substantially instantaneous reading each time he applies pressure (about once per second) to be sure that the proper pressure is attained.

In another embodiment a timing device such as an easily readable stop watch may be attached to the device to enable the rescuer to maintain the proper rythmn. Any other suitable adjustable timing device can be used using audible and/or visual signals, as an example. Electronic or other timing means and even a compact metronome device could be used. For example, with two rescuers the rythmm should be one compression and relaxation per second (compression comprising one half second relaxation one half second).

In another embodiment, the timing means may be an integral part of the pressure gauge, for example, the pressure gauge may be designed so that an appropriate time interval, e.g., one half second, is required for the pressure indicator pointer to relax to zero. Ideally, this timing feature is adjustable to suit different circumstances.

The resiliency of the inflatable "pillow" or other pressure applying means is a valuable feature of the invention. This resiliency tends to reduce the chances of damage or injury to the patient when administering cardiopulmonary resuscitation (CPR) by virtue of the fact that it provides for an even distribution of pressure. Further, it tends to absorb the harmful effects of improperly applied (CPR), such as sharp jabs rather than even, regular compressions. The "pillow"acts as a resilient, force equalizing and transmitting member and as a force receiving and transmitting means by evenly distributing the force applied directly thereto by the rescuer and by transmitting that force to the patient's chest. Accordingly, one embodiment of the invention would consist simply in an inflatable "pillow" or other similarly shaped structure of suitable material such as foam rubber for the application of CPR. Such a device would be of value even though it did not have the pressure sensing and pressure indicating means and other features described above. However, it could include these additional features or any combination thereof, including the use of the timing means.

Further improvement to the above-described embodiments is the provision of a pressure sensitive adhesive surface, such as medical adhesive tape, on the bottom of the "pillow" or resilient cushion. This adhesive would have a peel-off cover. Thus, the rescuer need only locate the proper position for the device, peel off the cover and apply it to the victim's chest. Then, should the rescuer have to stop the CPR for an interval because of moving or transporting the victim or to apply mouth- to-mouth resuscitation (one man rescue) the rescuer will not lose time in reapplying CPR because the device will have remainded in the proper position on the victim's chest. Further, the chance of causing damage by inadvertently applying pressure in the wrong place will be greatly reduced.

Any type of suitable pressure-sensing device coupled with a suitable pressure indicating means may be employed in the practice of this invention. For example, an electrical transducer might be used to sense pressure in the inflatable "pillow" or might be used to sense the direct pressure applied through the resilient cushion to the victim. Pressure indicating means may be a visual and/or an audible signal.

The accompanying drawings, which are incorporated in and constitute a part of this specification, illustrate the invention, and together, with the description serve to explain the principles of the invention.

Figure 1:
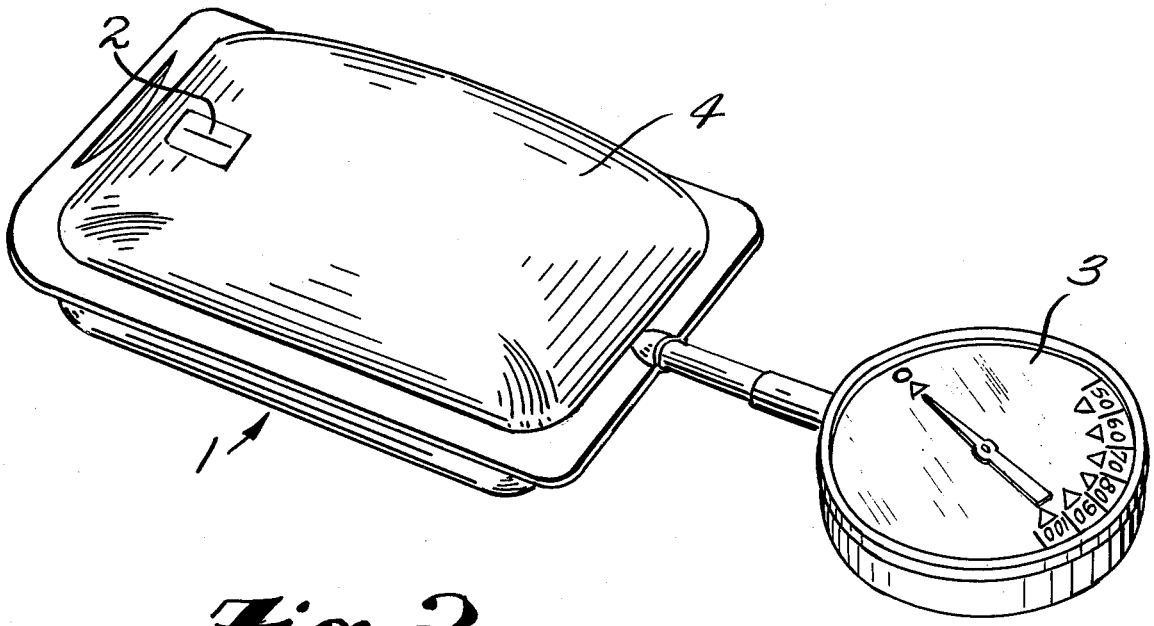
FIG. 1 is a perspective view of one embodiment of the invention.

With reference now to the drawings, wherein like reference characters designate like or corresponding parts throughout the several views, there is shown in FIG. 1 an inflatable "pillow" of vinyl or other suitable material 1 with an inflation valve 2, such as found in air mattresses and children's inflatable toys. The inflatable structure 1 is also provided with a pressure gauge 3 axially aligned with the "pillow" and which measures the pressure inside the inflatable structure 1. The pressure gauge 3 senses and indicates the downward force exerted on the structure 1, which force is related to but not necessarily equal to the pressure inside the structure 1. Optional instructions 4 may be printed on the top of the inflatable portion of the external cardiac resuscitation aid. In addition a timing means (not shown) may be used in conjuction with pressure gauge 3 to enable proper rythmical application of CPR.

Figure 2:
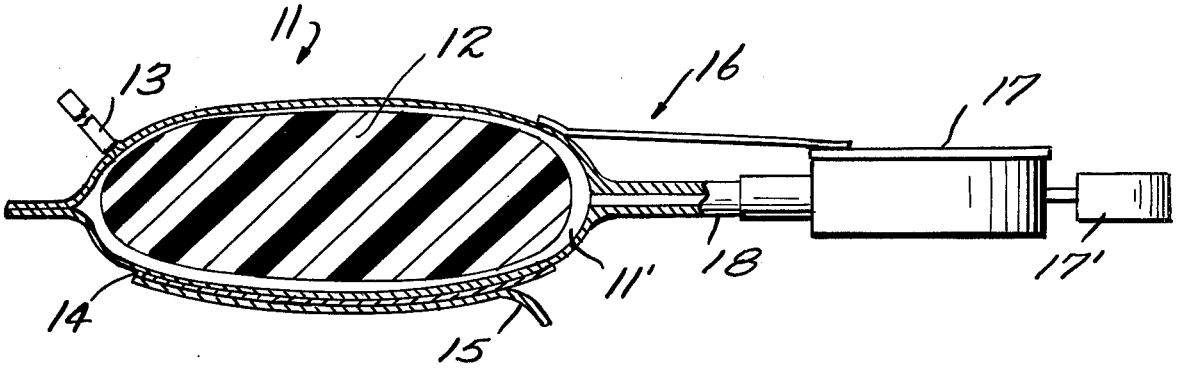
FIG. 2 shows a section of another embodiment of the invention.

FIG. 2 is a cross-sectional view of a similar embodiment with optional improvements. Inflatable vinyl pillow 11 is provided with one way inflation valve and tube 13. Inflation valve 13 is optional if the device is provided with its own sealed-in supply of air or other fluid. An optional, resilient, porous, foam rubber or porous foam plastic pad 12 may be located inside the inflatable or inflated vinyl pillow 11 to permit continued use of the pillow even if it becomes punctured and unable to hold air. Optional adhesive layer 14 may be located on the bottom surface of the pillow covered by removable sheet 15. A flexible instruction sheet 16 showing detailed instructions for CPR is attached both to the pillow and to pressure gauge 17. Instructions 16 and the face of pressure gauge 17 may be provided with luminous lettering or other indicia for use when no light is available. Pressure gauge 17 may be optionally designed so that the pressure indicator needle requires one half second or some other predetermined time interval to relax back to zero to provide for a timing reference for the rescuer. Another optional feature may provide for this relaxation time interval to be adjustable. This timing feature is illustrated in FIG. 2 by 17' and other timing means not specifically described herein may also be used. Hollow tube 18 conducts fluid pressure from the interior 11' of pillow 11 to pressure gauge 17 so that the force and pressure exerted by the rescuer on the pillow is registered on gauge 17.

Figure 3:
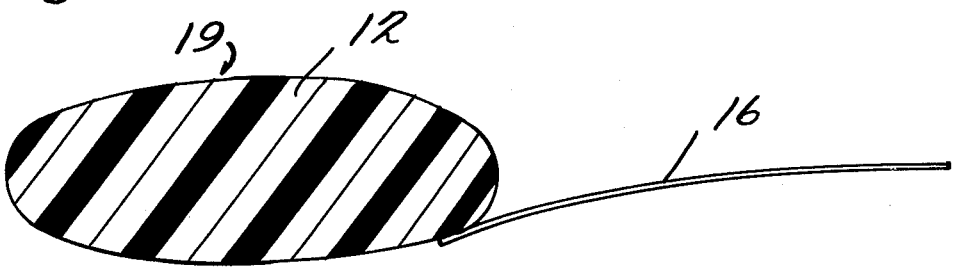
FIG. 3 is a cross-section of a further embodiment of the invention.

With reference now to FIG. 3, cushion or pillow 19 is constructed of suitably resilient foam rubber or foam plastic or other suitable material 12 to provide even pressure distribution in the application of CPR and to lessen harmful effects of improperly applied CPR. Optionally, instruction sheet 16 may also be provided attached to cushion 19. Though not shown, adhesive layer and removable sheet 14, 15 of FIG. 2 may be attached to the bottom of cushion 19.

Figure 4:
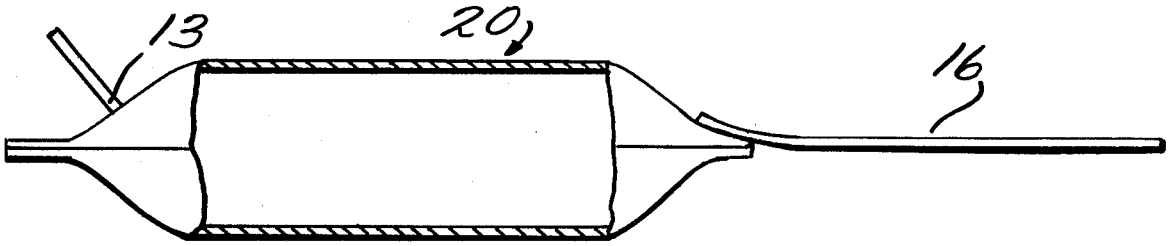
FIG. 4 is a cross-section of still another embodiment of the invention.
Figure 5:
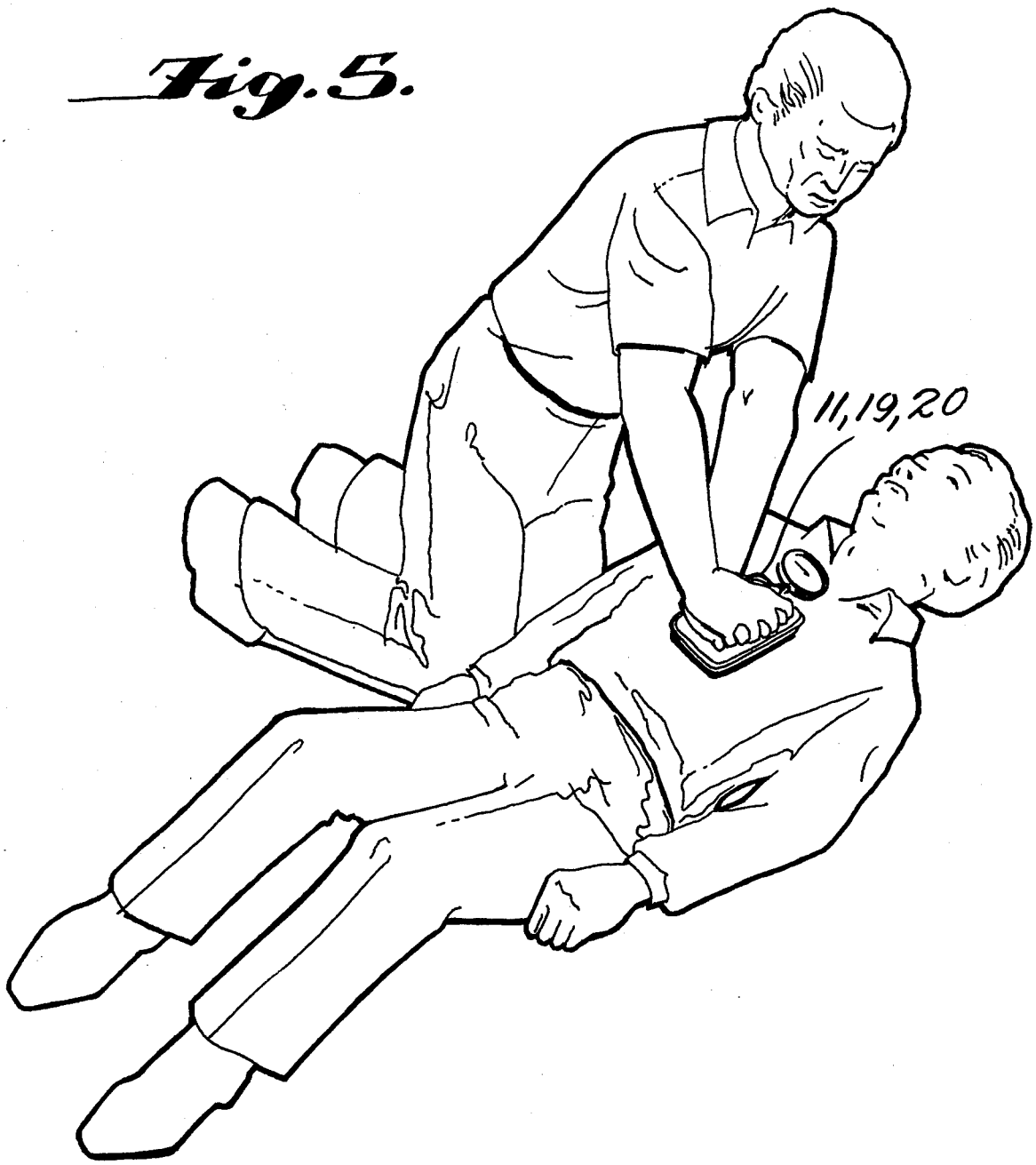
FIG. 5 is a view illustrating the application of CPR using the cushion or pillow of this invention.

FIG. 4 shows an inflatable pillow 20 which has an inflation tube and valve 13. Instruction sheet 16 is also attached to inflatable pillow 20. The pillow may be constructed of vinyl or other suitable material. This embodiment has the advantage, that it may be deflated and easily carried on the person or stored in a small space. Though not shown, the adhesive features 14 and 15 of FIG. 2 may also be provided with this unit.

The present invention provides for an inexpensive, portable, and compact device and method for assisting a rescuer in applying CPR by indicating the amount of pressure applied. The device may also provide for a predetermined time interval for relaxation to zero of the pressure gauge whereby a timing reference is also provided for the rescuer and whereby the correct rhythm can be followed in applying CPR. Studies have shown that up to 40% of persons trained in CPR forget the proper CPR techniques three months after having been trained. This invention enables anyone to properly administer CPR, even those who are untrained or those who have forgotten their training.

The invention in its broader aspects is not limited to the specific details shown and described, and departures may be made from such details without departing from the principles of the invention and without sacrificing its chief advantages.

What is claimed is:

1. Apparatus for use in administering cardiopulmonary resuscitation to a prone, face-up human patient, comprising:

means for placement on the chest of the patient between a user's hands and the patient's chest for receiving and transmitting forces to the patient's chest, the forces applied by placing the user's hands directly onto the receiving and transmitting means during cardiopulmonary resuscitation;

means in operative relationship with said receiving and transmitting means for sensing the forces directly applied to said receiving and transmitting means by the user's hands; and means configured to be normally and easily placed on the chest of the patient during use and in operative relationship with said sensing means and with said receiving and transmitting means for indicating the forces applied to the patient's chest

2. Apparatus as in claim 1 wherein said receiving and transmitting means is inflatable and further including means attached to said cushioning for enabling inflation thereof.

3. A method for administering cardiopulmonary resuscitation to a human patient by a rescuer with the use of a cushion, comprising the steps of:

positioning the patient on his back;

placing the cushion onto the patient's chest and over the lower sternum of the patient;

applying a downward force to the cushion and to the patient's chest for a first predetermined time interval by placing the rescuer's hands onto the cushion;

removing the application of said force to said cushion and to the patient's chest for a second predetermined time interval; and repeating the application and removal of force to the cushion and to the patient's chest as necessary.

4. A method as in claim 3 wherein said force applied to said cushion is a predetermined force as measured by a pressure gauge affixed to said cushion.

5. Apparatus for use in administering manual cardiopulmonary resuscitation to a human patient comprising:

force sensing means to be placed on the chest of the patient and beneath a user's hands for sensing the force applied by the user's hands via said sensing means to the patient's chest during resuscitation efforts; and means in operative relationship with said sensing means for indicating the force applied by the user's hands to the sensing means and to the patient's chest.

6. A method as in claim 3 wherein said first predetermined time interval is measured and displayed by said force sensing and indicating device.

7. A method for controlling the application of manual cardiopulmonary resuscitation by a rescuer to a human patient, comprising the steps of:

placing a force sensing and indicating device on the patient's chest;

applying a manual force to the device and via said device to the patient's chest by placing the rescuer's hands on the sensing and indicating device;

removing the application of force from the device and from the patient's chest; and repeating the application and removal of force to the device and to the patient's chest as necessary to effect resuscitation of the patient.

8. A method as in claim 7 wherein said force is applied during a first predetermined time interval.

9. A method as in claim 8 wherein said application of force is removed during a second predetermined time interval.

10. A method as in claim 9 wherein said second predetermined time interval is measured and displayed by said force sensing and indicating device.

11. A method as in claim 7 wherein said force applied is a predetermined force as measured and displayed by said force sensing and indicating device.

12. A method for controlling the application of cardiopulmonary resuscitation by a rescuer to a human patient by use of apparatus having an inflatable cushion and a pressure sensing gauge attached to said cushion said method comprising the steps of;

inflating the cushion;

placing the inflated cushion onto the patient's chest;

applying a force and pressure to the inflated cushion and via said cushion to the patient's chest by placing the rescuer's hands onto the inflated cushion;

observing the pressure sensing gauge at the same time said force and pressure are being applied to the inflated cushion to determine the amount of force being applied to the patient's chest;

removing the application of force and pressure from the inflated cushion and from the patient's chest when the gauge displays a predetermined reading; and repeating the application and removal of force and pressure to the inflated cushion and to the patient's chest.

13. A method as in claim 12 wherein said force and pressure are applied to the inflated cushion for a first predetermined time interval.

14. A method as in claim 13 wherein said application of force and pressure is removed from the inflated cushion for a second predetermined time interval.

15. A method as in claim 14 wherein said second predetermined time interval is measured and displayed by the pressure gauge.

16. A method as in claim 13 wherein said first predetermined time interval is measured and displayed by the pressure gauge.

17. A method as in claim 12 wherein said force applied to the inflated cushion is a predetermined force as measured and displayed by the gauge.

18. Apparatus for use by a rescuer in administering manual, emergency, external cardiac massage to a prone, face-up, human patient displaying symptoms of cardiac arrest, said apparatus consisting essentially of:

a resilient, force receiving and transmitting member configured to be placed on the chest of said prone, face-up patient to receive a downward, periodic force applied by the hands of said rescuer to create blood circulation within the patient; and means configured to be normally placed on the chest of the patient during use and operatively connected to said member for indicating the amount of said force applied by the rescuer.

19. Apparatus as in claim 18 further consisting essentially of timing means in operative relationship with said indicating means for enabling said indicating means to relax from a first predetermined reading to a second predetermined reading during a predetermined time interval when said force is removed by the rescuer from said resilient member.

20. Apparatus as in claim 19 wherein said timing means is adjustable to selectively adjust said time interval.

21. Apparatus as in claim 20 further consisting essentially of adhesive material affixed to said resilient member for enabling the member to be fixedly positioned on the patient's chest.

22. Apparatus as in claim 19 further consisting essentially of a sheet member removably positioned over said adhesive material.

23. Apparatus as in claim 18 wherein said resilient member is inflatable and further consisting essentially of means attached to said inflatable member for enabling inflation of said resilient member.

24. Apparatus as in claim 23 further consisting essentially of a porous, foam pad located within said inflatable member for enabling continued use of the apparatus even though said inflatable member becomes uninflatable.

25. Apparatus for use by a rescuer in administering manual, external cardiac massage to a human patient, comprising:

means configured to be placed on the chest of the patient between the rescuer's hands and the patient's chest for receiving force applied by placing the rescuer's hands onto the receiving means and for transmitting the force to the chest of the patient; and means operatively connected to said receiving and transmitting means and configured to be normally placed on the chest of the patient during use for indicating the amount of said force applied by the rescuer by placing the rescuer's hands onto the receiving means.

26. A method for administering manual, external cardiac massage by a rescuer in a controlled manner to a human patient, comprising the steps of:

placing a force transmitting and indicating device on the patient's chest;

applying a manual force to the device and via said device to the patient's chest by placing the rescuer's hands on the transmitting and indicating device;

observing the readings of said indicating device while said force is being applied;

removing the application of said force from the device and from the patient's chest when said indicating device reaches a first predetermined reading;

observing the readings of said indicating device while said force is removed from the device and from the patient's chest;

reapplying a manual force to the device and via said device to the patient's chest when the indicating device reaches a second predetermined reading; and continuing to reapply said manual force to the device and to the patient's chest via said device until said indicating device again reaches said first predetermined reading.

27. Apparatus for use in performing the resuscitation technique known as manual, external, cardiac compression, comprising:

means to be placed on the chest of a prone, face-up patient between a user's hands and the patient's chest for receiving and transmitting a force and pressure applied from the user's hands to the patient's chest by placing the user's hands onto the receiving and transmitting means during the performance of the technique known as manual, external, cardiac compression;

means configured to be normally placed on the chest of the prone, face-up patient during use and in operative relationship with said receiving and transmitting means for sensing the force and pressure applied to said receiving and transmitting means and to the patient's chest by the user's hands; and means configured to be normally placed on the chest of the prone, face-up patient during use and in operative relationship with said sensing means for indicating the force applied by the user's hands to the patient's chest via said receiving and transmitting means.

28. Apparatus as in claim 27 wherein said indicating means include means for indicating said force directly to the user and substantially instantaneously with respect to the application of said force to said receiving and transmitting means.

29. Apparatus for use in performing the resuscitation technique known as manual, external, cardiac compression, comprising:

means to be placed on the chest of a prone, face-up patient and beneath a user's hands for receiving a force applied by the user's hands to said receiving means and for transmitting said force to the patient's chest during the performance of said technique; and means configured to be placed on the chest of the prone, face-up patient and in operative relationship with said receiving and transmitting means for indicating the force applied by the user's hands to the receiving and transmitting means and to the patient's chest.

30. Apparatus as in claim 29 wherein said indicating means include means for indicating said force directly to the user and substantially instantaneously with respect to the application of said force to said receiving and transmitting means.

31. A method for controlling the performance of the technique known as manual, external, cardiac compression, comprising the steps of:

placing a force transmitting and indicating device onto a patient's chest and beneath a rescuer's hands;

applying a force directly to said device and via said device to the patient's chest by placing the rescuer's hands on the device;

observing the force being applied as indicated by said device;

controlling said application of force based on the observation of said device;

removing the application of force from the device and from the patient's chest based on the observation of said device;

observing the force being applied as indicated by said device while said force is removed from the device and from the patient's chest and;

repeating the application and removal of force to the device and via said device to the patient's chest as nesessary.

32. Apparatus for use by a rescuer in administering manual, emergency, external, cardiac massage to a prone, face-up human patient, said apparatus comprising:

a resilient cushion defining a hollow interior;

a fluid located within said hollow interior; and means configured to be normally placed during use on the chest of the prone, face-up patient and in operative relationship with said cushion for indicating forces exerted on said cushion by the rescuer.

33. Apparatus as in claim 32 wherein said indicating means are in fluid communication with the interior of said cushion.

34. Apparatus as in claim 33 wherein said indicating means are a pressure gauge.

35. Apparatus for use in administering cardiopulmonary resuscitation to a human patient, comprising;

means for placement on the chest of the patient between a user's hands and the patient's chest for receiving and transmitting forces and pressure applied by the user to the patient's chest during cardiopulmonary resuscitation;

means in operative relationship with said receiving and transmitting means for sensing the force applied to said receiving and transmitting means by the user;

means in operative relationship with said sensing means for indicating the forces applied to said receiving and transmitting means by the user; and timing means in operative relationship with said indicating means for enabling said indicating means to relax from any reading to a zero reading during a predetermined time interval.

36. Apparatus as in claim 35 wherein said timing means is adjustable to selectively adjust said time interval.

37. A method for administering cardiopulmonary resuscitation to a human patient by a rescuer with the use of a cushion, comprising the steps of:

positioning the patient on his back;

placing the cushion onto the patient's chest and over the lower sternum of the patient;

applying a downward force to the cushion and via said cushion to the patient's chest for a first predetermined time interval as determined by means attached to said cushion for indicating said time interval;

removing the application of said force to said cushion and to the patient's chest for a second predetermined time interval as determined by said indicating means attached to the cushion; and repeating the application and removal of force to the cushion and to the patient's chest.

38. Apparatus for use in administering cardiopulmonary resuscitation to a human patient, comprising:

means for placement on the chest of the patient between a user's hands and the patient's chest for receiving and transmitting forces and pressure applied by the user to the patient's chest during cardiopulmonary resuscitation;

means in operative relationship with said receiving and transmitting means for sensing the forces applied to said receiving and transmitting means by the user;

means in operative relationship with said sensing means for indicating the forces applied to said receiving and transmitting means by the user; and adhesive material affixed to said receiving and transmitting means for enabling said receiving and transmitting means to be fixedly positioned on the chest of the patient.

39. Apparatus as in claim 38 further including a sheet removably positioned over said adhesive material.

40. Apparatus for use in administering cardiopulmonary resuscitation to a human patient, comprising:

inflatable means for placement on the chest of the patient between a user's hands and the patient's chest for receiving and transmitting forces and pressure applied by the user to the patient's chest during cardiopulmonary resuscitation;

means in operative relationship with said receiving and transmitting means for sensing the forces applied to said receiving and transmitting means by the user;

means in operative relationship with said sensing means for indicating the forces or pressure applied to said receiving and transmitting means by the user; and a porous, foam pad located within said inflatable means.

41. Apparatus for use in administering manual cardiopulmonary resuscitation to a human patient comprising:

force sensing means for sensing force applied by a user's hands to the patient's chest during resuscitation efforts;

means in operative relationship with said sensing means for indicating the force applied by the user's hands to the patient's chest; and timing means in operative relationship with said indicating means for enabling said indicating means to relax from a first predetermined reading to a second predetermined reading during a predetermined time interval when force is removed by the user from said force sensing means.

42. Apparatus as in claim 41 wherein said timing means is adjustable to selectively adjust said time interval.

43. Apparatus for use by a rescuer in administering manual, external cardiac massage to a human patient, comprising:

means to be placed on the chest of the patient for receiving force applied by the rescuer and for transmitting the force to the chest of the patient;

means operatively connected to said receiving means for indicating the amount of said force applied by the rescuer; and timing means in operative relationship with said indicating means for enabling said indicating means to change from a first predetermined reading to a second predetermined reading during a predetermined time interval when the force is removed by the rescuer from the force receiving means.

44. Apparatus as in claim 43 wherein said timing means is adjustable to selectively adjust said time interval.

45. Apparatus as in claim 44 further including an adhesive material affixed to said receiving means.

46. Apparatus for use in performing the resuscitation technique known as manual, external, cardiac compression, comprising;

means to be placed on the chest of a patient between a user's hands and the patient's chest for receiving and transmitting a force and pressure from the user's hands to the patient's chest during the performance of the technique known as manual, external, cardiac compression;

means in operative relationship with said receiving and transmitting means for sensing the force and pressure applied to said receiving and transmitting means and to the patient's chest by the user's hands;

means in operative relationship with said sensing means for indicating the force applied by the user's hands to the patient's chest via said receiving and transmitting means; and timing means in operative relationship with said indicating means for enabling said indicating means to change from a first predetermined reading to a second predetermined reading during a predetermined time interval when force is removed by the user from said receiving and transmitting means.

47. Apparatus as in claim 46 wherein said timing means is adjustable to selectively adjust said time interval.

48. Apparatus as in claim 47 further including an adhesive material affixed to said receiving and transmitting means.

49. Apparatus for use in performing the resuscitation technique known as manual, external, cardiac compression, comprising:

means to be placed on the chest of a patient and beneath a user's hands for receiving a force applied by the user's hands to said receiving means and for transmitting said force to the patient's chest during the performance of said technique;

means in operative relationship with said receiving and transmitting means for indicating the force applied by the user's hands to the receiving and transmitting means and to the patient's chest; and timing means in operative relationship with said indicating means for enabling said indicating means to change from a first predetermined reading to a second predetermined reading during a predetermined time interval when force is removed by the user from said receiving and transmitting means.

50. Apparatus as in claim 49 wherein said timing means is adjustable to selectively adjust said time interval.

51. Apparatus as in claim 50 further including an adhesive material affixed to said receiving and transmitting means.

52. A method for controlling the application of cardiopulmonary resuscitation by a rescuer to a human patient by use of apparatus having a cushion and a gauge attached to said cushion, said method comprising the steps of:

placing the cushion onto the patient's chest;

applying a force to the cushion and via said cushion to the patient's chest by placing the rescuer's hands onto the cushion;

observing the gauge at the same time said force is being applied to the cushion to determine the amount of force being applied to the patient's chest;

removing the application of force from the cushion and from the patient's chest when the gauge displays a predetermined reading; and repeating the application and removal of force to the cushion and to the patient's chest.

53. A method as in claim 52 wherein said gauge is calibrated in units of force.

54. Apparatus for use in administering cardiopulmonary resuscitation to a human patient, comprising:

means for placement on the chest of the patient between a user's hands and the patient's chest for receiving forces applied by the user and for transmitting said forces to the patient's chest during cardiopulmonary resuscitation; and means configured for normal placement during use on the chest of the patient and extending from and in operative relationship with said receiving and transmitting means for sensing and indicating the forces applied to said receiving and transmitting means by the user.

55. Apparatus as in claim 54 wherein said indicating means is substantially axially aligned with said receiving and transmitting means.

56. Apparatus as in claim 55 further including timing means in operative relationship with said indicating means for enabling said indicating means to relax from a first predetermined reading to a second predetermined reading during a predetermined time interval when force and pressure is removed by the user from said receiving and transmitting means.

57. Apparatus as in claim 56 wherein said timing means is adjustable to selectively adjust said time interval.

58. Apparatus as in claim 55 further including adhesive material affixed to said receiving and transmitting means for enabling said receiving and transmitting means to be fixedly positioned on the patient's chest.

59. Apparatus as in claim 58 further including a sheet removably positioned over said adhesive material.

60. Apparatus as in claim 55 wherein said receiving and transmitting means is inflatable and further including means attached to said receiving and transmitting means for enabling inflation thereof.

61. Apparatus as in claim 60 further including a porous, foam pad located within said inflatable receiving and transmitting means.

62. Apparatus as in claim 54 wherein said indicating means substantially rigidly extends from said receiving and transmitting means to form a substantially rigid and unitary apparatus.

63. Apparatus as in claim 54 wherein said indicating means is positioned with respect to said receiving and transmitting means to enable the user to observe the indication of the forces applied while enabling the user to simultaneously observe the patient's chest area.

64. Apparatus for use in administering cardiopulmonary resuscitation to a human patient, comprising:

inflatable means for placement on the chest of the patient between a user's hands and the patient's chest for receiving and transmitting forces and pressure applied by the user to the patient's chest during cardiopulmonary resuscitation;

means in operative relationship with said receiving and transmitting means for sensing pressure created internally of said receiving and transmitting means by the user; and means in operative relationship with said sensing means for indicating directly and substantially instantaneously to the user the forces applied to said receiving and transmitting means by the user.

65. Apparatus for use by a rescuer in administering manual, emergency, external cardiac massage to a prone, face-up, human patient displaying symptoms of cardiac arrest, said apparatus comprising:

force receiving and transmitting means configured to be normally placed during use on the chest of said prone, face-up patient for receiving a downward, periodic force applied by said rescuer to create blood circulation within the patient; and means configured to be normally placed on the chest of the patient during use and operatively connected to said receiving and transmitting means for indicating to the rescuer the amount of said force applied by the rescuer.

* * * * *

UNITED STATES PATENT AND TRADEMARK OFFICE

CERTIFICATE OF CORRECTION

PATENT NO. : 4,077,400

DATED : March 7, 1978

INVENTOR(S) : Roy M. Harrigan

It is certified that error appears in the above-identified patent and that said Letters Patent are hereby corrected as shown below:

Claim 2, line 3, "cushioning" should read -- receiving and transmitting means -- .

Claim 6, line 1, the numeral "3" should read -- 8 -- .

Claim 22, line 1, the numeral "19" should read -- 21 -- .

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*